206-314 SR
10/22/85 OR 4,548,319

United States Patent [19]
Llorente

[11] Patent Number: 4,548,319
[45] Date of Patent: Oct. 22, 1985

[54] INDIVIDUAL CASE FOR A WIND INSTRUMENT REED

[75] Inventor: Jacques L. Llorente, La Garenne Colombes, France

[73] Assignee: Societe Anonyme dite, Paris, France

[21] Appl. No.: 536,900

[22] Filed: Sep. 28, 1983

[30] Foreign Application Priority Data

Oct. 27, 1982 [FR] France ..... 82 17970

[51] Int. Cl.[4] ..... A45C 11/00
[52] U.S. Cl. ..... 206/314
[58] Field of Search ..... 206/314, 353, 354

[56] References Cited

U.S. PATENT DOCUMENTS 540,319 6/1895 Kampfe ..... 206/353
1,057,387 3/1913 Winn ..... 206/354
1,750,119 3/1930 Muller ..... 206/354
2,910,173 10/1959 Fenburr ..... 206/314

*Primary Examiner*—William T. Dixson, Jr.
*Attorney, Agent, or Firm*—Scully, Scott, Murphy & Presser

[57] ABSTRACT

An individual case for a wind instrument reed is provided which is formed by a U shaped piece (2) with closely spaced apart arms (*2a,2b*) in which the width between the arms corresponds to the thickness of the reed (1), this U shaped piece (2) having a certain resilience in the direction allowing its arms (*2a,2b*) to move slightly apart, this U shaped piece (2) being provided with two facing notches (*3a,3b*) provided respectively in its two arms (*2a,2b*). Projections (4) exert a transverse nipping force on the body of the reed (1), whereas an abutment surface (5) bears on the tapering end of the reed.

6 Claims, 4 Drawing Figures

FIG.1
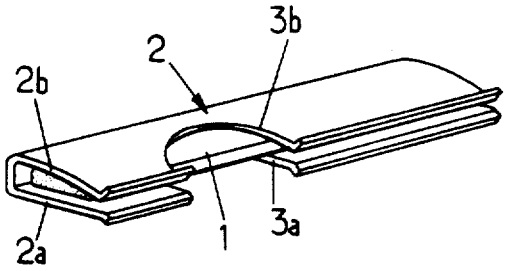
FIG. 2
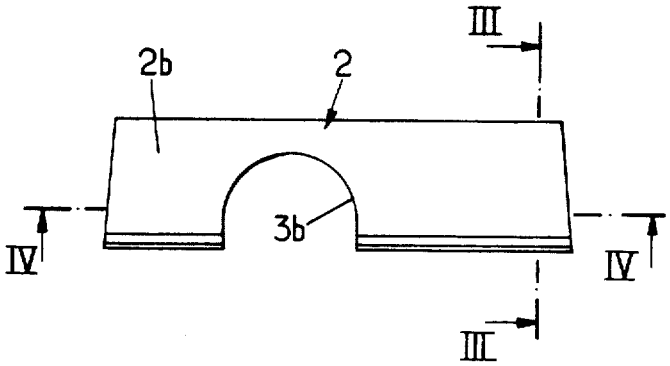
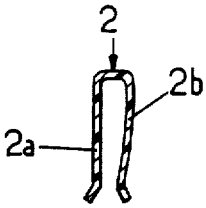
FIG. 3
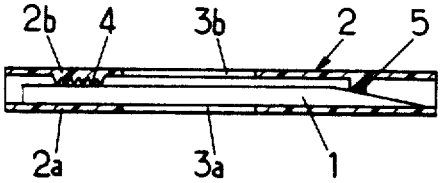
FIG. 4

INDIVIDUAL CASE FOR A WIND INSTRUMENT REED

BACKGROUND OF THE INVENTION

The invention relates to individual cases for housing wind instrument reeds.

Cases for flat objects are already known, which are formed by a flattened parallelepipedic shaped box comprising a hinged cover, means for securing the flat object against movement in this box and a device for closing the lid on the box.

Such a case is relatively expensive to manufacture and involves disposing the object either manually in the case, any automation of this operation being very difficult and, therefore very expensive to perform. Furthermore, it is generally intended to receive flat objects such as fingernail files or combs which are much less fragile than wind instrument reeds and which may be handled and packed without special precautions.

SUMMARY OF THE INVENTION

The present invention aims at providing an individual case for a wind instrument reed which is of a very low manufacturing cost, compatible with the price of the reed and which nevertheless allows the objects to be housed therein to be positioned automatically, while efficiently protecting them from shocks and movement.

To this end, the invention provides an individual case for a wind instrument reed, characterized by the fact that it is formed by a monobloc U shaped piece with closely spaced arms, in which the width between the arms corresponds to the thickness of the reed, this U shaped piece having a certain resilience in the direction allowing its arms to move slightly apart, said U shaped piece being provided with two facing notches, provided respectively in its two arms, and comprising, towards one of its two ends, nipping projections adapted to exert a transverse nipping force on the body of the reed towards its corresponding end, and towards its other end, at least one abutment surface adapted to bear on the tapered part of the reed, so as to secure it against motion transversely and/or axially.

In one advantageous arrangement of the invention, the two notches are provided at about the first third of the length of the U shaped piece, from its end provided with nipping projections.

Constructionally, these nipping projections are provided on one of the two arms of the U shaped piece.

According to yet another advantageous arrangement of the invention, the abutment surface is formed by at least one transverse shoulder extending from one of the two arms of the U shaped piece.

In a preferred method of manufacture, the case is made from a molded plastic material.

The invention consists, apart from the arrangements which have already been mentioned, of certain other arrangements which are used preferably at the same time and which will be more explicitly discussed hereafter.

A BRIEF DESCRIPTION OF THE DRAWING

One embodiment of the invention will be described hereafter in greater detail with reference to the accompanying drawings in which:

FIG. 1 is a perspective view showing the individual case for a wind instrument reed in accordance with the invention;

FIG. 2 is a top view of this case;

FIG. 3 is a section along line III—III of FIG. 2;

FIG. 4 is a section along line IV—IV of FIG. 2.

A DETAILED DESCRIPTION OF PREFERRED EMBODIMENTS

In FIG. 1, a persective view is shown representing an individual case in accordance with the invention for housing a wind instrument reed 1.

This individual case is formed by a monobloc U shaped piece whose two arms 2a,2b are closely spaced apart, the width between the arms corresponding to the thickness of the reed 1.

This U shaped piece 2 has a certain resilience in the direction allowing its arms 2a,2b to move slightly apart so as to allow the flat object 1 to be protected to be inserted in the case.

This U shaped piece 2 is provided with two facing notches 3a,3b formed respectively in its two arms 2a,2b; these two notches allow the flat object 1 housed in its case to be gripped and removed therefrom.

The U shaped piece 2 comprises, towards one of its ends, nipping projections 4 adapted to exert a transverse nipping force on the body of the reed 1 towards its corresponding end and, towards its other end, at least one abutment surface 5 bearing on the tapered end of the reed so as to secure it against motion transversely and/or axially.

With the nipping projections 4 and the abutment surface 5, the reed 1, housed in the case, is firmly held and can in no case come out accidentally.

The two notches 2a,2b are provided at about the first third of the length of the U shaped piece 2, from its end provided with the nipping projections 4.

These nipping projections 4 are advantageously provided on one of the two arms 2b of the U shaped piece 2.

Constructionally, these nipping projections 4 are formed by teeth orientated transversely with respect to the U shaped piece 2.

The abutment surface 5 may be formed by at least one transverse shoulder extending from one of the two arms 2b of the U shaped piece 2.

This abutment surface 5 is provided in the part of the U shaped piece 2 which is opposite, with respect to notches 3a,3b, the part which comprises the nipping projections 4.

The monobloc case which has just been described may be advantageously formed by molding a plastic material.

I claim:

1. A case for holding a wind instrument reed comprising a one piece body having a u-shaped transverse cross section and including:

first and second, resilient, longitudinally extending, transversely spaced arms forming a reed storage area, each arm having first and second longitudinal ends;

a back portion connecting the arms together;

nipping projections extending from a selected one of the arms, adjacent a first longitudinal end thereof, into the reed storage area to grip the reed;

an abutment surface extending from a selected one of the arms, adjacent a second longitudinal end thereof, into the reed storage area to further hold the reed;

the arms forming a pair of transversely aligned notches located approximately one-third the length of the arms from the first longitudinal ends thereof.

2. A case according to claim 1 wherein each arm includes:

a main portion, the main portions of the first and second arms being generally parallel; and a front lip slanting forwardly away from the reed storage area to facilitate inserting the reed thereinto.

3. A case according to claim 2 for use with a reed having a tapered head, and wherein:

the abutment surface extends from the first arm into the reed storage area; and the abutment surface includes a bottom edge slanting away from the first arm, toward the second longitudinal end of the second arm, to seat against the tapered head of the reed.

4. A case according to claim 3 wherein the abutment surface is formed by a transversely extending shoulder.

5. A case according to claim 3 wherein the nipping projections extend from the first arm, into the reed storage area.

6. A case according to claim 5 wherein the body is formed from a molded plastic material.

* * * * *

UNITED STATES PATENT AND TRADEMARK OFFICE

CERTIFICATE OF CORRECTION

PATENT NO. : 4,548,319

DATED : October 22, 1985

INVENTOR(S) : Jacques L. Llorente

It is certified that error appears in the above-identified patent and that said Letters Patent is hereby corrected as shown below:

On the title page, change the assignee from "Societe Anonyme dite, Paris, France," while it should be:

--Societe Anonyme dite: ETABLISSEMENTS VANDOREN, Paris, France,--

Signed and Sealed this

Fifth Day of July, 1988

*Attest:*

*Attesting Officer*

DONALD J. QUIGG

*Commissioner of Patents and Trademarks*